United States Patent [19]

Van Paesschen et al.

[11] 4,048,357

[45] Sept. 13, 1977

[54] METHOD OF COATING MULTI-LAYER GRAPHIC FILM

[75] Inventors: August Jean Van Paesschen, Antwerpen; Lucien Janbaptist Van Gossum, Kontich, both of Belgium

[73] Assignee: AGFA-GEVAERT N.V., Mortsel, Belgium

[21] Appl. No.: 645,273

[22] Filed: Dec. 29, 1975

Related U.S. Application Data

[63] Continuation of Ser. No. 404,675, Oct. 9, 1973, abandoned.

[30] Foreign Application Priority Data

Oct. 10, 1972 United Kingdom ..... 46727/72

[51] Int. Cl.[2] ..... B05D 3/00; G03C 1/76

[52] U.S. Cl. ..... 427/387; 96/87 R; 427/385 B; 427/407 G; 428/447; 428/480; 428/522

[58] Field of Search ..... 96/67, 87 R; 427/385, 427/387; 428/447, 483, 913

[56] References Cited

U.S. PATENT DOCUMENTS

| | | | |
|---|---|---|---|
| 2,785,085 | 3/1957 | Sayre | 427/331 |
| 3,591,379 | 7/1971 | Plakunov | 96/50 |
| 3,615,557 | 10/1971 | D'Cruz | 96/87 R |
| 3,615,561 | 10/1971 | Dolce | 96/87 R |
| 3,619,246 | 11/1971 | Bragole | 428/447 X |
| 3,733,215 | 5/1973 | Van Paesschen | 96/87 X |
| 3,758,308 | 9/1973 | Roos | 96/83 |

*Primary Examiner*—P.E. Willis, Jr.
*Attorney, Agent, or Firm*—William J. Daniel

[57] ABSTRACT

In a coating method for preparing a multi-layer material for use in the graphic arts or in X-ray photography in which a web of a polyester film support has applied to one of its sides to form an anchoring layer an aqueous binder latex containing at least one copolymer of vinyl chloride, vinylidene chloride, acrylic or methacrylic acid esters, vinyl esters, or butadiene, the anchoring layer is heated during drying or heat-setting to a temperature above the glass transition temperature of said copolymeric binder and is conveyed while hot by means of conveying rollers contacting said anchoring layer surface, and at least one gelatin-containing hydrophilic layer is applied to the anchoring layer, the tendency of said anchoring layer to adhere while hot to said conveying rollers or to a contiguous anchoring layer is reduced by incorporating an organo-silane compound in the anchoring layer in the amount of about 5–100% by weight of the copolymer binder.

6 Claims, No Drawings

METHOD OF COATING MULTI-LAYER GRAPHIC FILM

This application is a continuation of parent application Ser. No. 404,675 filed Oct. 9, 1973, now abandoned.

The invention relates to non-sticking anchoring layers for polyester films, more especially polyethylene terephthalate films, and to films comprising these non-sticking anchoring layers.

By the expression "non-sticking anchoring layers" used hereinafter are meant layers applied to polyester films with the purpose of improving the adhesion of hydrophilic layers to these films and characterized thereby that these anchoring layers do not stick to each other when pressed together at temperatures up to 130° C and pressures up to 100 kg/sq.cm.

When films of polyethylene terephthalate are used as supports in the graphic industry, it is usual to provide these polyester films with an adhesive layer in order to improve the adhesion thereto of other layers such as light-sensitive silver halide emulsion layers, layers containing diazo compounds, matting layers for drawing purposes, antistatic layers, coloured layers and the like. These adhesive layers are generally called anchoring layers, sub-coatings or primer coatings.

A great number of polymer types have been described as binder materials for these anchoring layers i.a. copolymers of vinyl chloride and/or vinylidene chloride (United Kingdom Pat. No. 1,234,755 filed Sept. 28, 1967 by Gevaert-Agfa N.V.), copolymers of butadiene (printed German Patent Application No. 2,105,527 filed Feb. 5, 1971 by Imp. Chem. Industries), and copolymers of unsaturated chloro- or cyanoacetyl esters (United Kingdom Pat. No. 1,143,843 filed July 4, 1967 by Bexford Ltd.).

Most of these copolymers are applied to the polyester film surface in the form of latices in view of several obvious economical reasons, the most important being the fact that these latices can directly be obtained in water by known emulsion polymerisation techniques so that the need of expensive organic solvents is avoided. These latices may be applied to the polyester film either before or after biaxial orientation of the film support.

By a proper choice of the copolymer composition the glass transition temperature of these latices is selected so that it is not too high, so that the latices possess good film forming and adhesive properties. The glass transition temperature of the copolymer mentioned usually varies between 20° and 50° C. Consequently, when the copolymer layers are heated in the drying ovens where usually dry air at 80 to 120° C is used, the copolymer layers become tacky. The polyester film provided with its anchoring layer should thus be cooled sufficiently when it leaves the drying chamber before it is brought in contact with the conveying rollers. If this is not the case, the anchoring layer will stick to the rollers and will be damaged or torn off thereby.

It is an object of the invention to reduce the stickiness of anchoring layers on polyester films without impairing their other properties.

According to the invention non-sticking anchoring layers on polyester films are provided, characterized in that anchoring layers containing as binder copolymers of vinyl chloride, of vinylidene chloride, of acrylic or methacrylic acid esters, of vinyl esters or of butadiene, comprise from 5 to 100%, preferably 15 to 50% by weight with respect to the weight of the binder of a silane compound corresponding to the formula:

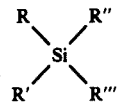

wherein :

each of R and R' represents hydrogen, alkyl, chloroalkyl, aminoalkyl, alkoxy, hydroxyalkoxy, aminoalkoxy, epoxyalkoxy, alkoxyalkoxy, acetyloxy, vinyl or phenyl, the different alkyl and alkoxy groups containing 1 to 4 carbon atoms, and each of R'' and R''' represents cyanoalkyl, aminoalkyl, aminoalkoxyalkyl, epoxyalkoxyalkyl, alkoxycarbonylalkyl, (meth) acryloyloxyalkyl, (meth)acrylamidoalkyl, chloroacetamidoalkyl, N(aminoalkyl)-aminoalkyl, bis(N-hydroxyalkyl)-aminoalkyl, alkoxy, hydroxyalkoxy, aminoalkoxy, epoxyalkoxy, alkoxyalkoxy, phenoxy, acetyloxy, and 3[7-oxabicyclo-(4,1,0)-heptyl]-alkyl, the different alkyl or alkoxy groups containing 1 to 4 carbon atoms.

Suitable silane compounds according to the invention are e.g. :

dimethyl-diphenoxy-silane
dimethyl-bis(2,3-epoxypropoxy)-silane
diphenoxy-diphenyl-silane
diethoxy-dimethyl-silane
diethoxy-methyl-(4-aminobutyl)-silane
diethoxy-diphenyl-silane
2-(ethoxycarbonyl)-propyl-diethoxy-silane
dimethoxy-methyl-[N(2-aminoethyl)-3-amino-2-methyl-propyl]-silane
dimethoxy-bis[N-(2-hydroxyethyl)]-3-aminopropyl-silane
3-chloropropyl-trimethoxy-silane
trimethoxy-3-(methacryloyloxy)propyl-silane
trimethoxy-[N-(2-aminoethyl)-3-aminopropyl]-silane
trimethoxy-[3-(2,3-epoxypropoxy)-propyl]-silane
bis(2-aminoethoxy)-methyl-[3-(2-aminoethoxy)-propyl]-silane
trimethoxy-2 {3-[7-oxabicyclo-(4,1,0-heptyl)]-ethl}-silane triethoxy-silane
methyl-triethoxy-silane
triethoxy-vinyl-silane
phenyl-triethoxy-silane
2-cyanoethyl-triethoxy-silane
3-aminopropyl-triethoxy-silane
(2-ethoxycarbonyl-ethyl)-triethoxy-silane
(3-chloroacetamido-propyl)-triethoxy-silane
(3-acrylamidopropyl)-triethoxy-silane
tripropoxysilane
tributoxysilane
tris(2-methoxyethoxy)-vinyl-silane
tris(2,3-epoxypropoxy)-ethyl-silane
tetraethoxysilane
tetrapropoxysilane
tetrabutoxysilane
tetrabis(2,3-dihydroxypropoxy)-silane
vinyl-triacetoxy-silane These silane compounds are added to the coating composition of the anchoring layer in amounts comprised between 5 and 100%, preferably between 15 and 50% by weight, calculated on the weight of binder material present in the anchoring layer.

Anchoring layers for polyester films, which can be improved by addition to their coating composition of silane compounds according to the invention, comprise as binder copolymers having as main monomeric constituents vinyl chloride, vinylidene chloride, acrylic or methacrylic acid esters, vinyl esters, or butadiene. Suitable copolymers are e.g.

co(vinyl chloride/vinylidene chloride/n-butyl acrylate/itaconic acid) (63:30:5:2% by weight)
co(vinyl chloride/vinylidene chloride/n-butyl acrylate/itaconic acid) (58:30:10:2% by weight)
co(vinylidene chloride/methyl acrylate/itaconic acid) (88:10:2% by weight)
co(vinyl acetate/crotonic acid) (95.5% by weight)
co(ethyl acrylate/methacrylic acid) (80/20% by weight)
co(butadiene/methyl methacrylate/itaconic acid) (42.5:42.5:5% by weight).

These copolymers are preferably applied to the polyester film from aqueous dispersions directly resulting from copolymerisation of the different monomers by emulsion polymerisation techniques. The coating composition for the anchoring layer can be admixed with known coating aids such as dispersing agents, spreading agents, and thickening agents, which in general are highly viscous water-soluble polymers having as sole object to adapt the viscosity of the coating composition to the desired degree. A survey of the thickening of latices and of the thickening agents that may be used has been given by Houben-Weyl in "Methoden der organischen Chemie, Makromoledulare Stoffe", vol. 14/1, pages 519 and 536, Georg Thieme Verlag, Stuttgart (1961).

The coating composition for the adhesive layer is applied to the polyester film in such a ratio that after drying upon the stretched polyester film a layer having a thickness between 0.10 and 2 μm is obtained.

The tackiness of the anchoring layer and the reduction of the tackiness of these layers by the addition of silane compounds according to the invention, can be measured very simply. Two film strips of the material are placed in a heated press for 150 s, the two anchoring layers facing each other. The press has been previously heated to 125° C and kept at this temperature during the whole pressure period, using a pressure of 70 kg/sq.cm. The experiments described in the example have been carried out with a Carver Laboratory Press, manufactured by Fred S. Carver, New York. Anchoring layers containing no silane compounds according to the invention show a heat sealing effect such that the two film strips can hardly be separated from each other. So, both film strips are damaged usually. As a result of the addition of silane compounds according to the invention, in amounts comprised between 5 and 100% by weight, preferably between 15 and 50% by weight, calculated on the weight of binder present in the copolymer layer, the sticking of the anchoring layers to each other is usually entirely avoided. Furthermore no quality loss whatsoever was observed as to the covering of the anchoring layer itself, of the following layer, of the brightness and the aspect of the layer, the adhesion of the anchoring layer to the polyester film support, nor of the adhesion of the following layers to the anchoring layer.

Anchoring layers containing silane compounds on polyester film can be used as supports in the manufacture of photographic materials containing light-sensitive silver halide. They can also be used as supports for the manufacture of drafting film, coloured film materials, antistatic film material and for all applications known in graphic arts.

The examples hereinafter are especially directed to the use of polyethylene terephthalate film as support for the anchoring layer and the other layers applied thereto. The anchoring layer can, however, be applied also to other polyester films, e.g., films of polyesters resulting from the polycondensation of glycol, or mixtures of glycols with terephthalic acid, or mixtures of terephthalic acid with minor amounts of other dicarboxylic acids such as isophthalic acid, diphenic acid and sebacic acid.

The invention is illustrated by the following examples.

EXAMPLE 1

A layer is applied to a longitudinally stretched polyethylene terephthalate film having a thickness of 0.35 mm from the following coating composition at a ratio of 75 sp.m/liter:

| | |
|---|---|
| copolymer A | 350 ml |
| copolymer B | 1.8 ml |
| water | 630 ml |

Copolymer A is a 20% by weight latex of a copolymer of vinyl chloride, vinylidene chloride, n-butyl acrylate and itaconic acid (63:30:5:2% by weight).

Copolymer B is a 20% by weight latex of the copolymer of ethyl acrylate and methacrylic acid (80:20% by weight).

After having been dried the polyester film is transversally stretched 3.5 times together with the layer. Two film strips of the material obtained are pressed in a heated press as hereinbefore defined, the two anchoring layers facing each other. After 150 s of heating at 125° C and pressing at 70 kg/sp.cm two films become heat-sealed and can hardly be separated so that the anchoring layers are damaged considerably.

When the above coating composition for the anchoring layer is admixed with 25 ml of trimethoxy-[3(2,3-epoxypropoxy) propyl]-silane per liter and the coated films are heated and pressed in the same way in the press, the film strips separate spontaneously after cooling.

Both film materials, one of them carrying an anchoring layer without, the other with a silane compound are coated with a subbing layer at the side of the anchoring layer at a ratio of 35 sq.m/liter with the following coating composition:

| | | |
|---|---|---|
| 10% aqueous solution of gelatin | 100 | ml |
| 30 % aqueous colloidal dispersion of silicon dioxide | 50 | ml |
| 10 % aqueous solution of 3-hydroxy-methyl-2,4-pentanediol | 25 | ml |
| 10 % aqueous solution of caprolactam | 50 | ml |
| 10 % aqueous solution of ULTRAVON W | 5 | ml |
| 10 % solution of methanol in HEXAPON D | 2.5 | ml |
| methanol | 400 | ml |
| water | 362.5 | ml |
| 10 % aqueous solution of glyoxal | 5 | ml |

ULTRAVON W is the trade-name of CIBA A.G., Switzerland, for a dispersing agent consisting of the disodium salt of heptadecyl-benzimidazole disulphonic acid.

HEXAPON D is the trade-name of Societe Chimique Elbeuvienne for a dispersing agent of formula:

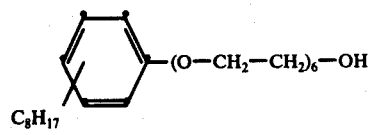

When the thus subbed film materials are coated with a gelatin silver halide emulsion layer as used for lithographic purposes, no difference as to their photographic properties can be noticed. There is no difference either in the adhesion of the two light-sensitive layers to the polyester support.

EXAMPLE 2

An anchoring layer is applied to a longitudinally stretched polyethylene terephthalate film having a thickness of 0.63 mm, from the following coating composition at a ratio of 75 sp.m/liter:

| | |
|---|---|
| co(vinylidene chloride/methyl acrylate/ itaconic acid) (88:10:2 % by weight) as a 20 % latex | 350 ml |
| water | 650 ml |

After having been dried the polyester film is transversally stretched 3.5 times. Two film strips of the material obtained are pressed in a heated press as hereinbefore defined, the two anchoring layers facing each other. The press is heated at 125° C and pressed for 150 s. As a result of this heating the two film strips are heat-sealed and cannot be separted any longer without tearing of the film strips.

Other samples of the above longitudinally stretched polyethylene terephthalate film are covered with the same coating composition, to which, however, per liter of coating composition 30 ml of trimethoxy-3(methacryloyloxy)-propylsilane had been added. When two film strips of the material as indicated above are heated and pressed, the film strips separate spontaneously after cooling.

The same good results are obtained when the silane compound added above is replaced by 25 ml of dimethoxy-methyl-[N(2-aminoethyl)-3-amino-2-methyl-propyl]-silane.

Both film materials carrying anchoring layers comprising silane compounds are coated with subbing layers as indicated in Example 1, followed by a gelatin silver halide emulsion layer as used for lithographic purposes. The photographic properties of both materials are not impaired by the presence of silane compounds in the anchoring layers. The adhesion of the emulsion layers to the support was excellent too.

EXAMPLE 3

In accordance with the process of example 1, a blue polyethylene terephthalate film as used in X-ray photography was coated with an anchoring layer comprising as binder the same co(vinyl chloride/vinylidene chloride/n-butyl acrylate/itaconic acid) (63:30:5:2% by weight) as described in Example 1. When per liter of the coating composition for the anchoring layer 10 ml of trimethoxy-2{ 3[7-oxabicyclo-(4,1,0)-heptyl]-ethyl } -silane are added, no heat-sealing is noticed in the heat-pressing experiment.

The dried anchoring layers are coated at 35 sq.m/liter with a subbing layer from the following coating composition:

| | | |
|---|---|---|
| 10 % aqueous solution of gelatin | 80 | ml |
| 20 % aqueous latex of co(butadiene/methyl methacrylate)(50:50 % by weight) | 50 | ml |
| 30 % aqueous dispersion of colloidal silicon dioxide | 66 | ml |
| 10 % aqueous solution of sodium sulphosalicylate | 30 | ml |
| 1,3-glycidyl-2-hydroxypropane | 1 | ml |
| 10 % aqueous solution of ULTRAVON W (trade-name) | 7.5 | ml |
| methanol | 100 | ml |
| water | 665.5 | ml |

The subbed materials are covered with a photographic silver halide emulsion layer as used in X-ray photography. No difference as to the photographic properties of the light-sensitive materials can be noticed between the material without silane compound in the anchoring layer and the material containing a silane compound in the anchoring layer. The adhesion of the emulsion layers to the support is excellent also in both materials.

EXAMPLE 4

In accordance with the process of example 1 a polyethylene terephthalate film is provided with an anchoring layer comprising co(vinyl chloride/vinylidene chloride/n-butyl acrylate/itaconic acid) (58:30:10:2% by weight) as binder.

In the first sample the anchoring coating composition does not contain a silane compound, whereas in a second sample 40 ml of trimethoxy-[bis-N(2-hydroxyethyl)-3-amino-propyl]-silane are added per liter of coating composition.

The presence of the silane compound renders the second anchoring layer non-sticking as is proved in the heated press.

The anchoring layer of both samples is covered with a matting layer of 12 μm thickness from the following coating composition:

| | |
|---|---|
| crystalline silicon dioxide (max. particle size 10 μm) | 200 g |
| melamine formaldehyde resin | 100 g |
| phenyl trichlorosilane | 5 ml |
| hydroxypropylcellulose | 1 g |
| polyethylene oxide (mol.weight 20,000) | 20 g |
| ammonium salt of perfluorocaprylic acid | 25 g |
| water | 40 ml |
| ethylene glycol monomethyl ether | 180 ml |
| acetone | 430 ml |

Excellent drawing films for pencil and ink are obtained. The presence of the silane compound in the second material has no influence on the properties of the matting layer.

EXAMPLE 5

The copolymer forming the binder of the anchoring layer in Example 2 is replaced by a same amount of co(butadiene/methyl methacrylate/itaconic acid) (42.5:42.5:5% by weight). The coating composition is applied to the polyethylene terephthalate film support before stretching.

The anchoring layer does not stick when 25 ml of trimethoxy-[3(2,3-epoxypropoxy)-propyl]-silane are added per liter of coating composition.

EXAMPLE 6

A biaxially oriented polyethylene terephthalate film is provided with an anchoring layer at a ratio of 75 sq.m/liter from the following coating composition:

| | |
|---|---|
| co(vinyl acetate/crotonic acid) (95:5 % by weight) | 25 g |
| methanol | 500 ml |
| water | 500 ml |

The dried layer showed to be sticky when pressed in a heating press as indicated above.

The addition of 5 g of trimethoxy-[3(2,3-epoxypropoxy)-propyl]-silane per liter of coating composition rendered the layer completely non-sticking in the same circumstances.

EXAMPLE 7

A substantially amorphous polyethylene terephthalate film having a thickness of approximatively 2.2 mm was formed by extrusion of molten polyethylene terephthalate at about 280° C on a quench drum, chilled to about 75° C and then stretched in the longitudinal direction over a differential speed roll stretching device to 3.5 times its initial dimension at 84° C.

To the thus stretched film a layer was applied at a ratio of 70 sq.m/liter from the following coating composition:

| | |
|---|---|
| latex | 335 ml |
| 1,1,1-tri(hydroxymethyl)-propane | 12 g |
| thickening agent | 14.25 ml |
| sodium salt of sulphosalicylic acid | 10 g |
| trimethoxy[3(2,3-epoxypropoxy)-propyl] -silane | 50 ml |
| gelatin | 5 g |
| 10 % aqueous solution of ULTRAVON W (trade name) | 5 ml |
| water | 600 ml |

The pH of the coating composition was adjusted to 8.2 with ammonia.

The latex used had a concentration of 20% by weight and was formed by the emulsion copolymerization of vinyl chloride, vinylidene chloride, n-butyl acrylate, and itaconic acid (63:30:5.2% by weight) such as described in United Kingdom Pat. No. 1,234,755 filed Sept. 28, 1967 by Gevaert-Agfa N.V.

The thickening agent was the copolymer of ethyl acrylate and methacrylic acid (80:20% by weight). It was added in the form of an aqueous dispension having a concentration of 20% by weight.

After drying of the coating the film was stretched to 3.5 times in the transverse direction at about 87° C in a tenter frame. The final thickness of the film was about 0.180 mm.

In an extension of the tenter frame the film was heat-set at 200° C for about 1 min while being kept under tension. Subsequently the film was cooled. The heat-set and cooled film was then conducted through a relaxation station where it was heated at 125° C for about 2 min under reduced tension so that it could shrink.

Two strips of the heat-set and relaxed film material were pressed together in a heated press as hereinbefore defined, both adhesive layers facing each other. After 150 s of heating at 125° C and pressing at 70 kg/sq.cm the strips separated spontaneously after cooling.

When in the coating composition as described above the trimethoxy [3-(2,3-epoxypropoxy)-propyl]-silane was omitted the two film strips after pressing together as hereinafter defined, were heat-sealed and could no longer be separated without tearing of the film strips.

The heat-set film was further treated with a corona discharge and was provided with a gelatin silver halide emulsion layers as used in photographic X-ray material. The layers of the photographic material thus obtained showed a very good adhesion to the polyester film support in wet as well as in dry state.

What is claimed is:

1. In a coating method for preparing a multi-layer material for use in the graphic arts or in X-ray photography in which a web of a polyester film support has applied to one of its sides to form an anchoring layer an aqueous binder latex containing at least one copolymer of vinyl chloride, vinylidene chloride, acrylic or methacrylic acid esters, vinyl esters, or butadiene, the anchoring layer is heated during drying or heat-setting to a temperature above the glass transition temperature of said copolymeric binder and is conveyed while hot by means of conveying rollers contacting said anchoring layer surface, and at least one gelatin-containing hydrophilic layer is applied to the anchoring layer, the improvement of reducing the tendency of said anchoring layer to adhere while hot to said conveying rollers or to a contiguous anchoring layer by incorporating a silane compound in said anchoring layer in the amount of about 5-100% by weight of said copolymer binder, said silane compound corresponding to the formula:

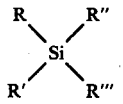

wherein:

each of R and R' represents hydrogen, alkyl, chloroalkyl, aminoalkyl, alkoxy, hydroxyalkoxy, aminoalkoxy, epoxyalkoxy, alkoxyalkoxy, acetyloxy, vinyl or phenyl, wherein alkyl contains 1 to 4 carbon atoms; and each of R'' and R''' represents cyanoalkyl, aminoalkyl, aminoalkoxyalkyl, epoxyalkoxyalkyl, alkoxycarbonylalkyl, (meth)acryloyloxyalkyl, (meth)acrylaminoalkyl, chloroacetamidoalkyl, N-(aminoalkyl)-aminoalkyl, bis-(hydroxyalkyl)-aminoalkyl, alkoxy, hydroxyalkoxy, aminoalkoxy, epoxyalkoxy, alkoxyalkoxy, phenoxy, acetyloxy, and 3-[7-oxabicyclo-(4,1,0)-heptyl]-alkyl, wherein alkyl contains 1 to 4 carbon atoms whereby the tendency of the anchoring layer of becoming tacky during drying of said layer or during transversal stretching, heat-setting or relaxation of the polyester film support to which said layer was applied is reduced and sticking of the anchoring layer to the conveyor rollers with which it is brought into contact before it is sufficiently cooled thus obviated without a corresponding reduction in the adhesion of the anchoring layer to said polyester support.

2. The method of claim 1 wherein said anchoring layer is heated to a temperature within the range of about 80°–120° C.

3. The method of claim 1 wherein said silane compound is incorporated in said anchoring layer in the amount of about 15–50% by weight of the copolymeric binder therein.

4. The method of claim 1 wherein the polyester film is a film of polyethylene terephthalate.

5. The method of claim 1 wherein the silane compound is taken from teimethoxy-[3-(2,3-epoxypropoxy)-propyl]-silane, trimethoxy-[3(methacryloloxy)propyl]-silane, dimethoxymethyl-[N(2-aminomethyl)-3-amino-2-methyl-propyl]-silane, trimethoxy-2-{3[7-oxabicyclo-(4,1,0)-heptyl]-ethyl}-silane, and trimethoxy-[bis-N(2-hydroxyethyl)-3-aminopropyl]-silane.

6. The method of claim 1 wherein said hydrophilic layer is a light-sensitive gelatin silver halide emulsion layer.

* * * * *